US007934407B2

(12) United States Patent
Oguri et al.

(10) Patent No.: US 7,934,407 B2
(45) Date of Patent: May 3, 2011

(54) PROCESS FOR PRODUCING METALLIC COMPONENT AND STRUCTURAL MEMBER

(75) Inventors: Kazuyuki Oguri, Nagoya (JP); Takahiro Sekigawa, Nagoya (JP); Akiko Inoue, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 444 days.

(21) Appl. No.: 12/224,959

(22) PCT Filed: Mar. 14, 2007

(86) PCT No.: PCT/JP2007/055141

§ 371 (c)(1),
(2), (4) Date: Sep. 10, 2008

(87) PCT Pub. No.: WO2007/105775

PCT Pub. Date: Sep. 20, 2007

(65) Prior Publication Data

US 2009/0023014 A1 Jan. 22, 2009

(30) Foreign Application Priority Data

Mar. 15, 2006 (JP) ..... 2006-070794

(51) Int. Cl.
*B21D 31/06* (2006.01)
*B05D 3/12* (2006.01)

(52) U.S. Cl. ..... 72/53; 29/90.7; 427/299; 451/38

(58) Field of Classification Search ..... 72/53; 451/38; 29/90.7; 427/188, 299
See application file for complete search history.

(56) References Cited

U.S. PATENT DOCUMENTS

| | | | | |
|---|---|---|---|---|
| 3,073,022 | A * | 1/1963 | Bush et al. | 72/53 |
| 4,914,796 | A * | 4/1990 | Lioy et al. | 205/151 |
| 5,598,730 | A * | 2/1997 | Dillon | 72/53 |
| 7,871,671 | B2 * | 1/2011 | Oguri et al. | 427/299 |

FOREIGN PATENT DOCUMENTS

| | | |
|---|---|---|
| JP | 2002-285237 | 10/2002 |
| JP | 2002-301663 | 10/2002 |
| JP | 2003-170353 | 6/2003 |
| JP | 2004-346424 | 12/2004 |
| JP | 2005-248259 | 9/2005 |
| JP | 2005-264331 | 9/2005 |

OTHER PUBLICATIONS

International Search Report mailed Jun. 12, 2007 for International Application No. PCT/JP2007/055141.

(Continued)

*Primary Examiner* — David B Jones
(74) *Attorney, Agent, or Firm* — Wenderoth, Lind & Ponack, L.L.P.

(57) ABSTRACT

A process for producing a metallic component of a structural member or the like used in an aircraft or automobile or the like, the process including shot peening the surface of a metallic material, wherein the fatigue properties of the metallic material are improved with almost no variation in the surface roughness over the course of shot peening. Shot peening the metallic material surface uses a shot material having an average particle size of not more than 200 μm, and the ratio of the surface roughness of the metallic material surface following the projection step relative to the surface roughness of the metallic material surface prior to the projection step is not less than 0.8 and not more than 1.5.

6 Claims, 7 Drawing Sheets

OTHER PUBLICATIONS

T. Dörr et al., "Influence of Shot Peening on Fatigue Performance of High-Strength Aluminum- and Magnesium Alloys", The 7$^{th}$ International Conference on Shot Peening, 1999, Institute of Precision Mechanics, Warsaw, Poland. Internet <URL: http://www.shotpeening.org/ICSP/icsp-7-20.pdf>; pp. 153-160.

Yasuhiro Kataoka et al., "Surface Modification of Aluminum Alloys by Micro Particles Peening and Coating", Research Report from Aichi Industrial Technology Institute (2002), Internet <URL: http://www.aichi-inst.jp/html/reports/repo2002/r1-2.PDF> w/concise explanation of relevance in English.

* cited by examiner (a)

| | |
|---|---|
| Surfcorder SE -2300 | |
| V. mag. | 5000 |
| H. mag. | 50 |
| Length | 2.0mm |
| Drive speed | 0.1mm/s |
| Cutof f | 0.8mm |
| Ra | 1.64 μm |
| Rt | 8.11 μm |
| Rmax | 8.79 μm |
| Rz | 7.74 μm |
| RmaxD | 8.11 μm |
| RzD | 6.85 μm |

(b)

| | |
|---|---|
| Surfcorder SE -2300 | |
| V. mag. | 5000 |
| H. mag. | 50 |
| Length | 2.0mm |
| Drive speed | 0.1mm/s |
| Cutof f | 0.8mm |
| Ra | 1.69 μm |
| RMS | 2.00 μm |
| Rt | 7.57 μm |
| Rmax | 11.57 μm |
| Rz | 9.78 μm |
| RmaxD | 7.33 μm |
| RzD | 6.95 μm |

(a)

| | |
|---|---|
| Surfcorder SE -2300 | |
| V. mag. | 2000 |
| H. mag. | 50 |
| Length | 2.0mm |
| Drive speed | 0.1mm/s |
| Cutof f | 0.8mm |
| Ra | 3.2 μm |
| Rt | 12.9 μm |
| Rmax | 16.0 μm |
| Rz | 14.3 μm |
| RmaxD | 12.6 μm |
| RzD | 12.2 μm |

(b)

| | |
|---|---|
| Surfcorder SE -2300 | |
| V. mag. | 5000 |
| H. mag. | 50 |
| Length | 2.0mm |
| Drive speed | 0.1mm/s |
| Cutof f | 0.8mm |
| Ra | 2.89 μm |
| RMS | 3.22 μm |
| Rt | 13.08 μm |
| Rmax | 13.57 μm |
| Rz | 11.81 μm |
| RmaxD | 11.52 μm |
| RzD | 10.64 μm |

PROCESS FOR PRODUCING METALLIC COMPONENT AND STRUCTURAL MEMBER

TECHNICAL FIELD

The present invention relates to a process for producing a metallic component having improved fatigue properties and a structural member.

BACKGROUND ART

Shot peening represents a known example of a surface modification process that is used for enhancing the fatigue strength of metallic materials such as the structural members used in aircraft and automobiles and the like (see Non Patent Citation 1). Shot peening is a method in which, by blasting countless particles having a particle size of around 0.8 mm (the shot material) together with a stream of compressed air onto the surface of a metallic material, the hardness of the metallic material surface is increased, and a layer having compressive residual stress is formed at a certain depth.

Furthermore, other techniques such as flapper peening and cold working are also used as methods of enhancing the fatigue strength of a metallic material.

Non Patent Citation 1: T. Dorr and four others, "Influence of Shot Penning on Fatigue Performance of High-Strength Aluminum- and Magnesium Alloys", The 7th International Conference on Shot Peening, 1999, Institute of Precision Mechanics, Warsaw, Poland. Internet <URL: http://www-.shotpeening.org/ICSP/icsp-7-20.pdf>

DISCLOSURE OF INVENTION

However, shot peening increases the surface roughness of the member, meaning the prescribed surface roughness required for a particular application may not always be attainable. Furthermore, because of the increase in surface roughness and the effect of flaws generated on the surface of the member by the shot, a partial reduction in the degree of improvement in fatigue properties achieved by shot peening is unavoidable. A process that enables the fatigue properties of a member to be enhanced by shot peening while suppressing any increase in the surface roughness of the member or any flaw generation has yet to be discovered.

On the other hand, flapper peening does not induce a high level of compressive residual stress, and as a result, satisfactory fatigue properties cannot be obtained. Furthermore, cold working processes require post-processing, meaning the process is more complex.

Moreover, shot peening may also cause plastic deformation of the surface layer of the member, which can cause deformation problems such as bending. As a result, these types of problems have typically been prevented by using a tape or film-like pressure-sensitive adhesive mask to cover those areas of the material for which deformation such as bending or an increase in the surface roughness is likely to be problematic prior to shot peening. However, attaching and then removing a pressure-sensitive adhesive mask requires considerable effort, and results in extra costs.

Moreover, when shot peening, if a shot particle strikes an edge of the member, then plastic deformation at the edge can cause a portion to fly off the member, generating a so-called burr. Because this type of burr can cause a deterioration in the fatigue properties of the member, the edges of metallic components must be chamfered or rounded prior to shot peening in order to prevent the generation of such burrs. However, chamfering or rounding of the edges is typically performed manually, meaning the efficiency is poor.

The present invention has been developed in light of these circumstances, and has an object of providing a process for producing a metallic component of a structural member or the like used in an aircraft or automobile or the like, the process comprising shot peening the surface of a metallic material, wherein the fatigue properties of the metallic material can be improved with almost no variation in the surface roughness over the course of shot peening.

Furthermore, the present invention also has an object of providing a process for producing a metallic component of a structural member or the like used in an aircraft or automobile or the like, the process comprising shot peening the surface of a metallic material, wherein by reducing deformation of the metallic material and suppressing increases in the surface roughness, covering of the metallic material surface becomes unnecessary, and the metallic component can be produced at a reduced cost.

Moreover, the present invention also has an object of providing a process for producing a metallic component of a structural member or the like used in an aircraft or automobile or the like, the process comprising shot peening the surface of a metallic material, wherein chamfering or rounding of edges prior to shot peening is unnecessary, enabling reductions in the number of process steps and the production costs.

In order to achieve the objects described above, the present invention adopts the aspects described below.

Namely, a process for producing a metallic component according to the present invention comprises a projection step (a shot peening step) of projecting particles onto the surface of a metallic material comprising a lightweight alloy or a steel, wherein the average particle size of the particles is not more than 200 μm, and the ratio of the arithmetic mean roughness of the surface of the metallic material following the projection step relative to the arithmetic mean roughness of the surface of the metallic material prior to the projection step is not less than 0.8 and not more than 1.5.

According to this process, a metallic component having improved fatigue properties can be produced with small change in the surface roughness of the metallic material.

In the following description, the surface roughness represented by the arithmetic mean roughness Ra is referred to as simply "the surface roughness". Furthermore, in the present invention, the "average particle size" is determined as the particle size corresponding with the peak in a frequency distribution curve, and is also referred to as the most frequent particle size or the modal diameter. Alternatively, the average particle size may also be determined using the methods listed below.

(1) A method in which the average particle size is determined from a sieve curve (the particle size corresponding with R=50% is deemed the median diameter or 50% particle size, and is represented using the symbol $dp_{50}$).
(2) A method in which the average particle size is determined from a Rosin-Rammler distribution.
(3) Other methods (such as determining the number average particle size, length average particle size, area average particle size, volume average particle size, average surface area particle size, or average volume particle size).

The surface roughness of the metallic material prior to the projection step is preferably not less than 0.7 μm and not more than 65 μm.

If the surface roughness of the metallic material prior to the projection step is less than 0.7 μm, then the ratio of the surface roughness of the metallic material surface following the projection step relative to the surface roughness prior to the projection step tends to increase, and the effect of the present invention in improving the fatigue properties tends to diminish, which is undesirable.

In order to ensure that the produced metallic component has satisfactory fatigue strength, the absolute value of the compressive residual stress at the metallic material surface following the projection step is preferably not less than 150 MPa.

In the process for producing a metallic component according to the present invention, projection of the particles onto the surface of the metallic material may be performed without using the type of mask that is attached to the surface of a metallic material during conventional shot peening in order to prevent increases in the surface roughness or deformation of the metallic material.

According to the process for producing a metallic component of the present invention, in addition to the fact that the surface roughness of the metallic material undergoes almost no change over the course of the projection step, almost no deformation such as bending occurs on the metallic material, meaning the type of pressure-sensitive adhesive mask used in conventional shot peening is unnecessary, and as a result, the steps of attaching and removing the pressure-sensitive adhesive mask are also unnecessary, enabling a dramatic reduction in the number of process steps and the production costs for the metallic components.

Furthermore, in the process for producing a metallic component according to the present invention, neither chamfering nor rounding of the edges of the metallic material, which are conducted prior to the projection step in conventional shot peening in order to prevent the occurrence of burrs, need be performed.

According to the process for producing a metallic component of the present invention, because no burrs are produced by plastic deformation even if a shot material particle strikes an edge of the metallic material, chamfering or rounding of the edges prior to the projection step is unnecessary. Accordingly, the number of process steps and the production costs for the metallic component can be reduced dramatically.

Furthermore, a structural member of the present invention includes a metallic component produced using one of the production processes described above.

This structural member has excellent fatigue properties, and has no deformation such as bending and no excessive surface roughness. Furthermore, because production can be performed without the need for covering with a pressure-sensitive adhesive mask and without chamfering or rounding of the edges, the structural member can be produced at a reduced cost. This structural member can be used favorably in the field of transportation machinery such as aircraft and automobiles, and in other fields that require favorable material fatigue properties.

The present invention provides a process for producing a metallic component of a structural member or the like used in an aircraft or automobile or the like, the process comprising shot peening the surface of a metallic material, wherein the fatigue properties of the metallic material can be improved with almost no variation in the surface roughness over the course of shot peening.

Furthermore, the present invention also provides a process for producing a metallic component of a structural member or the like used in an aircraft or automobile or the like, the process comprising shot peening the surface of a metallic material, wherein by reducing deformation of the metallic material and suppressing increases in the surface roughness, covering of the metallic material surface becomes unnecessary, and the metallic component can be produced at a reduced cost.

Moreover, the present invention also provides a process for producing a metallic component of a structural member or the like used in an aircraft or automobile or the like, the process comprising shot peening the surface of a metallic material, wherein chamfering or rounding of edges prior to shot peening is unnecessary, enabling reductions in the number of process steps and the production costs.

BEST MODE FOR CARRYING OUT THE INVENTION

Figure 1:
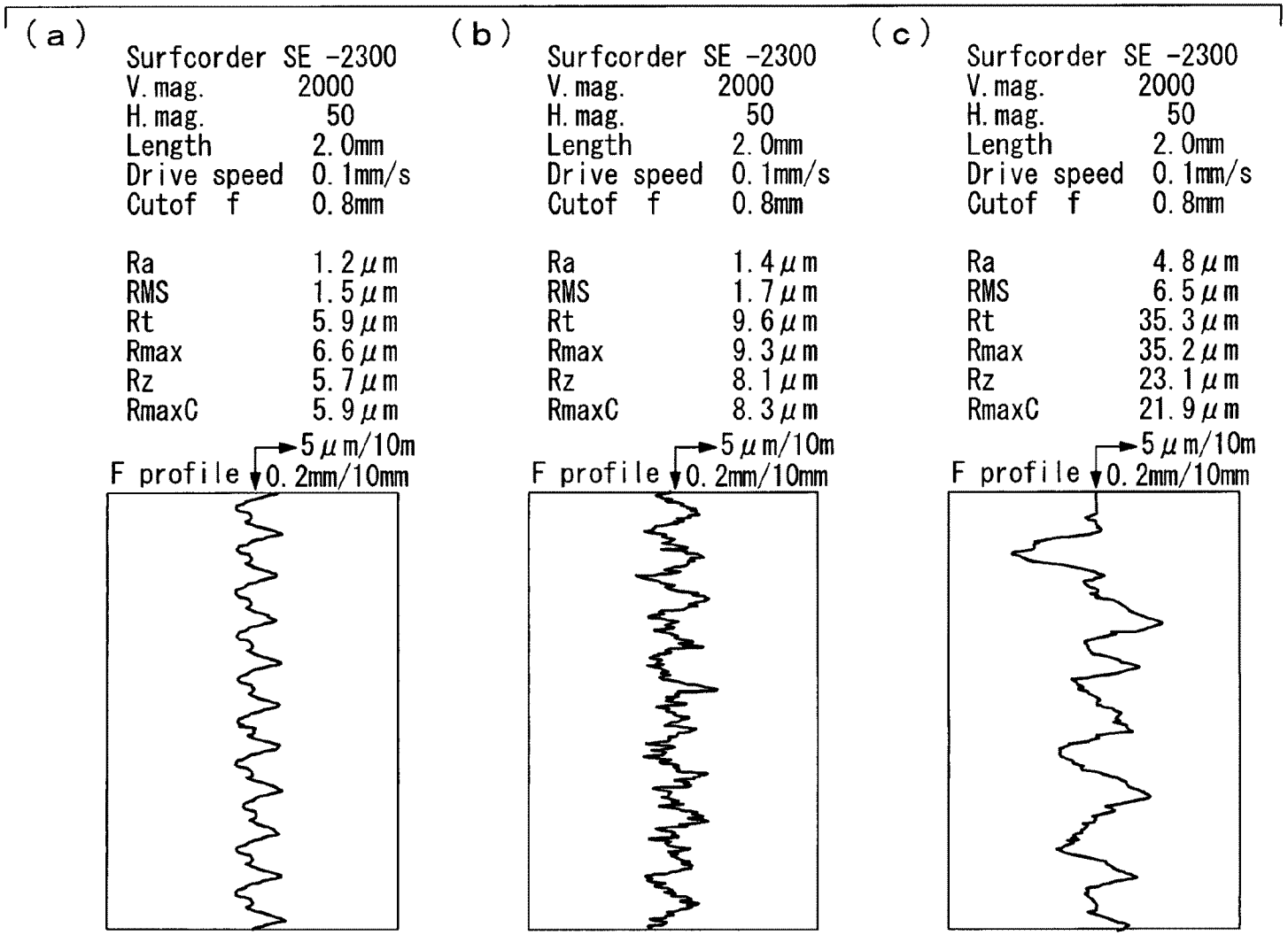
FIG. 1 A diagram showing the surface profiles of an aluminum alloy with a surface roughness of 1.2 μm before and after shot peening, wherein (a) represents the surface profile prior to shot peening, (b) represents the surface profile following shot peening in Example 1, and (c) represents the surface profile following shot peening in Comparative Example 3.

A description of embodiments of the process for producing a metallic component according to the present invention is presented below, with reference to the drawings.

In the process for producing a metallic component according to the present invention, a lightweight alloy material or steel material is used. Examples of the lightweight alloy include aluminum alloys and titanium alloys.

In the process for producing a metallic component according to the present invention, the particles (the shot material) used in shot peening the metallic material are hard particles of a metal, ceramic or glass or the like, and are preferably ceramic particles such as alumina or silica particles.

In conventional shot peening, a shot material with a particle size of around 0.8 mm is used, but in the present invention, a shot material with an average particle size of not more than 200 μm is used. The average particle size of the shot material is preferably not less than 10 μm and not more than 200 μm, and is even more preferably not less than 30 μm and not more than 100 μm. If the average particle size of the shot material particles is greater than 200 μm, then the excessively large kinetic energy of the particles causes damage to the material surface, meaning a satisfactory improvement in the fatigue life cannot be achieved. Furthermore, if the average particle size of the shot material particles is smaller than 10 μm, then blockages and the like of the shot material mean achieving a stable spray state is very difficult.

The shot velocity of the shot material is regulated by the air pressure of the compressed air stream. When shot peening according to the present invention, the air pressure is preferably not less than 0.1 MPa and not more than 1 MPa, and is even more preferably not less than 0.3 MPa and not more than 0.6 MPa. If the air pressure is greater than 1 MPa, then the excessively large kinetic energy of the particles causes damage to the material surface, meaning a satisfactory improvement in the fatigue life cannot be achieved. Furthermore, if the air pressure is less than 0.1 MPa, then achieving a stable spray state becomes very difficult.

The shot material particles are preferably spherical in shape. The reason for this preference is that if the shot material particles are sharp, then the surface of the metallic component may become damaged.

The coverage by shot peening is preferably not less than 100% and not more than 1,000%, and is even more preferably not less than 100% and not more than 500%. At coverage levels of 100% or lower, a satisfactory improvement in the fatigue strength cannot be obtained. Furthermore, coverage levels of 1,000% or higher are also undesirable, as the increase in temperature at the material surface causes a reduction in the compressive residual stress at the outermost surface, and a satisfactory improvement in fatigue strength cannot be obtained.

A metallic component that has been shot peened under the conditions described above preferably exhibits the surface properties (surface compressive residual stress and surface roughness) described below.

[Surface Compressive Residual Stress]

In a metallic component that has been shot peened in accordance with the present invention, a high compressive residual stress of not less than 150 MPa exists either at the outermost surface of the material, or within the vicinity thereof. As a result, the surface is strengthened and fatigue failure occurs not at the surface, but within the interior of the material, meaning the fatigue life increases significantly.

[Surface Roughness]

The treatment by shot peening in the present invention is performed so that there is almost no change in the surface roughness over the course of the treatment. The ratio of the surface roughness following shot peening relative to the surface roughness prior to shot peening is preferably not less than 0.8 and not more than 1.5. If this surface roughness ratio exceeds 1.5, then the surface of the metallic component following shot peening tends to be rough, which results in surface damage and can cause an undesirable reduction in the fatigue life.

By shot peening the metallic material under the above conditions, a surface-treated metallic component of the present invention is obtained.

A more detailed description of the process for producing a metallic component according to the present invention is presented below using a series of examples and comparative examples.

EXAMPLE 1 AND EXAMPLE 2

A sheet of an aluminum alloy material (7050-T7451, dimensions: 19 mm×76 mm×2.4 mm) was used as a test specimen. One surface of this specimen was shot peened using a shot material composed of alumina/silica ceramic particles with an average particle size (most frequent particle size) of not more than 50 μm, under conditions including an air pressure of 0.4 MPa and a spray time of 30 seconds.

Two aluminum alloy materials having different surface roughness values were prepared as the pre-shot peening materials. In Example 1, an aluminum alloy material with a surface roughness of 1.2 μm prior to shot peening was used, whereas in Example 2, an aluminum alloy material with a surface roughness of 2.9 μm prior to shot peening was used.

A dynamic microparticle shot apparatus (model number: P-SGF-4ATCM-401, manufactured by Fuji Manufacturing Co., Ltd.) was used as the shot peening apparatus.

Following shot peening, the surface roughness, compressive residual stress, and degree of deformation of the test specimens were measured.

Figure 2:
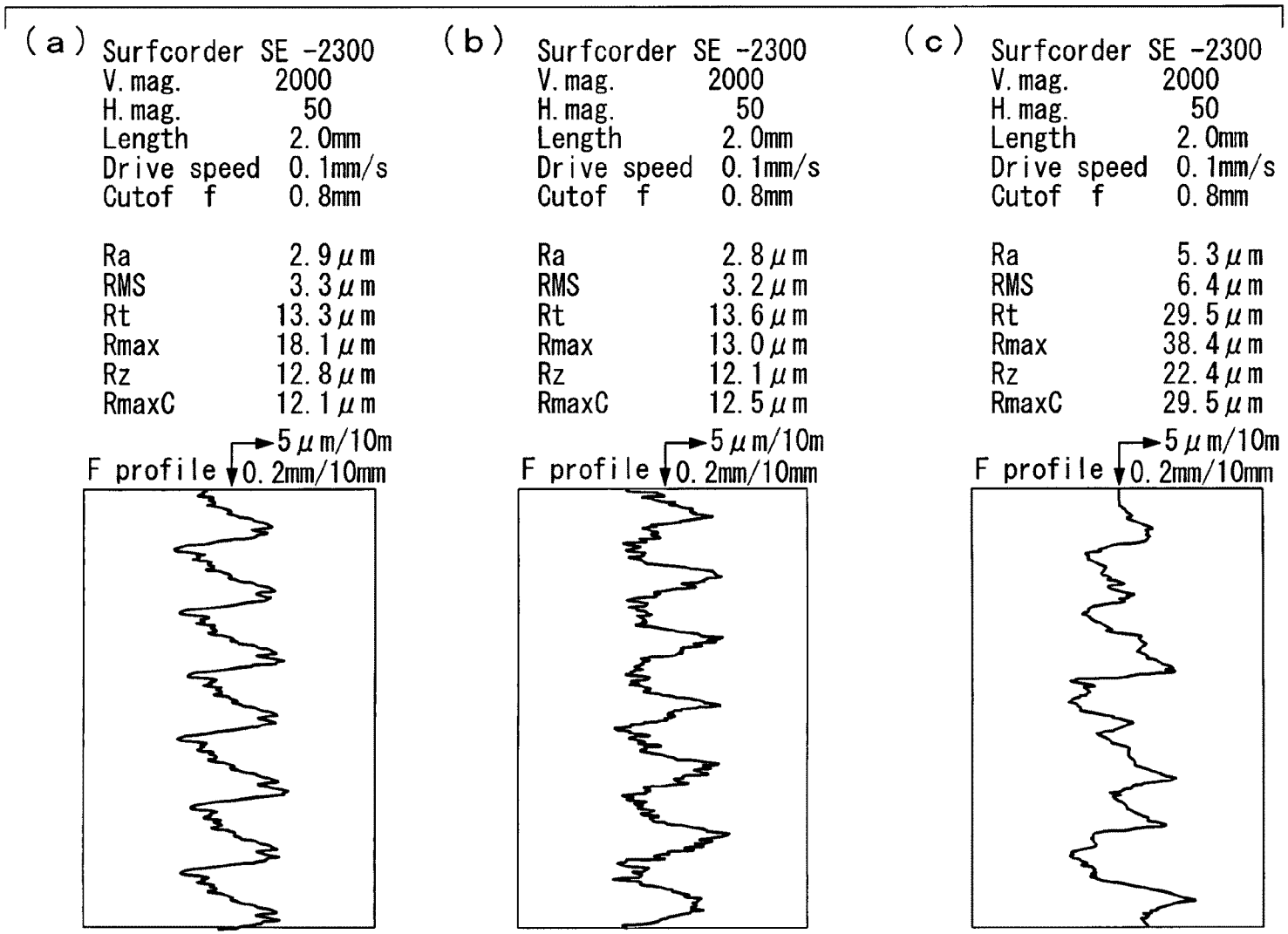
FIG. 2 A diagram showing the surface profiles of an aluminum alloy with a surface roughness of 2.9 μm before and after shot peening, wherein (a) represents the surface profile prior to shot peening, (b) represents the surface profile following shot peening in Example 2, and (c) represents the surface profile following shot peening in Comparative Example 4.

The conditions for shot peening in Example 1 and Example 2, the surface roughness values for the test specimens before and after shot peening, and the compressive residual stress, surface roughness and degree of deformation of the test specimens following shot peening are shown in Table 1. Furthermore, the surface profiles before and after shot peening in Example 1 are shown in FIG. 1(*a*) and FIG. 1(*b*) respectively, and the surface profiles before and after shot peening in Example 2 are shown in FIG. 2(*a*) and FIG. 2(*b*) respectively.

COMPARATIVE EXAMPLE 1 AND COMPARATIVE EXAMPLE 2

With the exception of replacing the shot material with conventional zirconia particles having an average particle size (most frequent particle size) of 250 μm, shot peening in Comparative Example 1 and Comparative Example 2 was performed in the same manner as in Example 1 and Example 2, respectively.

The conditions for shot peening of Comparative Example 1 and Comparative Example 2, the surface roughness values for the test specimens before and after shot peening, and the compressive residual stress, surface roughness, degree of deformation and fatigue life of the test specimens following shot peening are shown in Table 1.

COMPARATIVE EXAMPLE 3 AND COMPARATIVE EXAMPLE 4

With the exception of replacing the shot material with conventional cast steel particles having an average particle size (most frequent particle size) of 500 to 800 μm, shot peening in Comparative Example 3 and Comparative Example 4 was performed in the same manner as in Example 1 and Example 2, respectively.

The conditions for shot peening in Comparative Example 3 and Comparative Example 4, the surface roughness values for the test specimens after shot peening, and the compressive residual stress, surface roughness, degree of deformation and fatigue life of the test specimens following shot peening are shown in Table 1. Furthermore, the surface profile and after shot peening in Comparative Example 3 is shown in FIG. 1(*c*), and the surface profile before and after shot peening in Comparative Example 4 is shown in FIG. 2(*c*).

EXAMPLE 3 AND EXAMPLE 4

With the exception of replacing the test specimen with a sheet of a titanium alloy material (Ti-6A1-4V (an annealed material), dimensions: 19 mm ×76 mm ×2.4 mm), shot peening in Example 3 and Example 4 was performed in the same manner as in Example 1 and Example 2, respectively.

Two titanium alloy materials having different surface roughness values were prepared as the pre-shot peening materials. In Example 3, a titanium alloy material with a surface roughness of 1.64 μm prior to shot peening was used, whereas in Example 4, a titanium alloy material with a surface roughness of 3.2 μm prior to shot peening was used.

Figure 3:
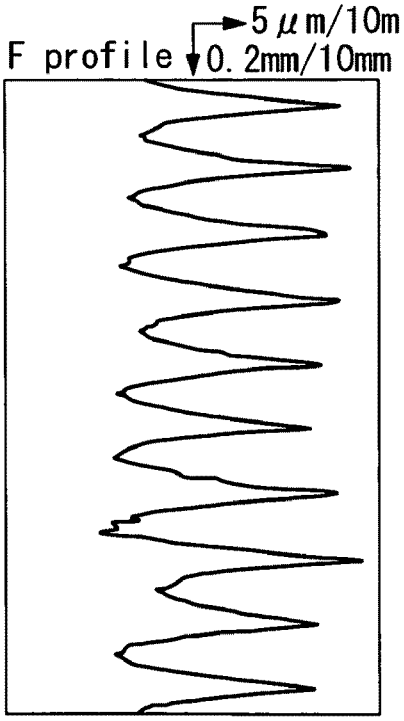
FIG. 3 A diagram showing the surface profiles of a titanium alloy with a surface roughness of 1.64 μm before and after shot peening, wherein (a) represents the surface profile prior to shot peening, and (b) represents the surface profile following shot peening in Example 3.
Figure 3:
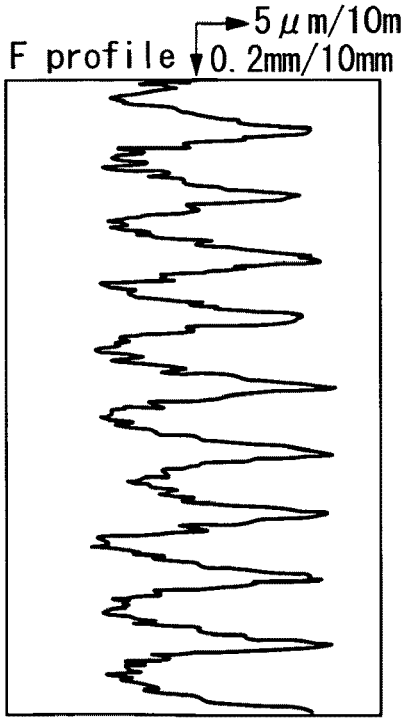
Figure 4:
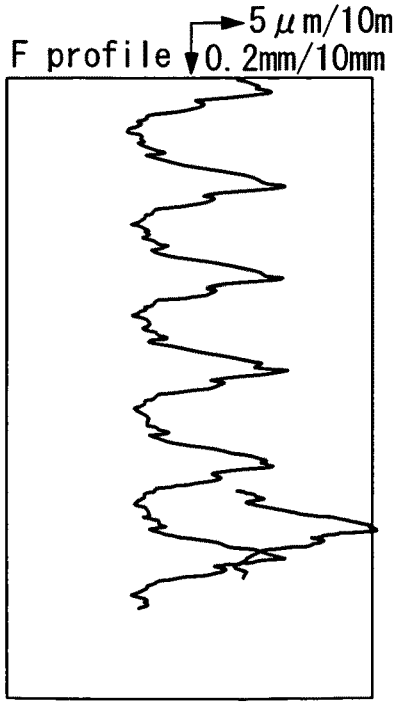
FIG. 4 A diagram showing the surface profiles of a titanium alloy with a surface roughness of 3.2 μm before and after shot peening, wherein (a) represents the surface profile prior to shot peening, and (b) represents the surface profile following shot peening in Example 4.
Figure 4:
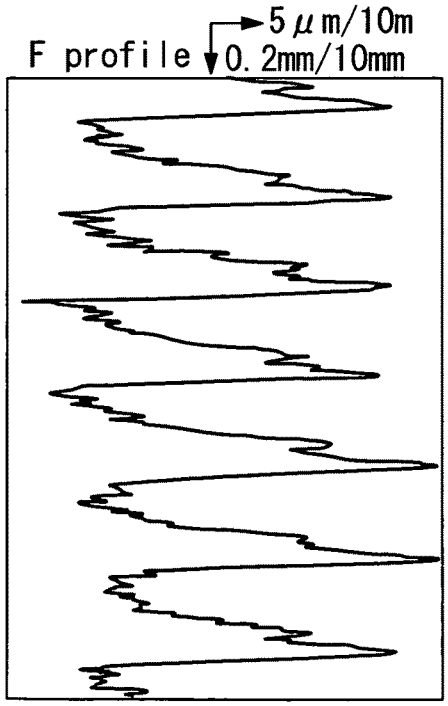

The conditions for shot peening in Example 3 and Example 4, the surface roughness values for the test specimens before and after shot peening, and the compressive residual stress, surface roughness, degree of deformation and fatigue life of the test specimens following shot peening are shown in Table 1. The fatigue life was evaluated by performing a tension-tension fatigue test (stress ratio R =0.1, maximum stress: 345 MPa) on a round bar-shaped smooth test specimen having a length of 135 mm and a gauge diameter of 6.35 mm. Furthermore, the surface profiles before and after shot peening in Example 3 are shown in FIG. 3(*a*) and FIG. 3(*b*) respectively, and the surface profiles before and after shot peening in Example 4 are shown in FIG. 4(*a*) and FIG. 4(*b*) respectively.

TABLE 1

| | Substrate | Shot material (particle size) (shot strength) | Air pressure Pa | Shot times | Coverage % |
|---|---|---|---|---|---|
| Example 1 | Al alloy | Alumina/silica | 0.4 | 30 | 100 |
| Example 2 | Al alloy | (<53 μm) (0.004 N) | 0.4 | 30 | 100 |
| Comparative example 1 | Al alloy | Zirconia (250 μm) | 0.2 | 30 | 100 |
| Comparative example 2 | Al alloy | (0.01 N) | 0.2 | 30 | 100 |
| Comparative example 3 | Al alloy | Cast steel (500 to 800 | | | 100 |
| Comparative example 4 | Al alloy | μm) (0.006 N) | | | 100 |
| Example 3 | Ti alloy | Alumina/silica | 0.4 | 30 | 100 |
| Example 4 | Ti alloy | (<53 μm) (0.004 N) | 0.4 | 30 | 100 |

| | Pre-shot roughness Ra μm | Post-shot roughness Ra μm | Residual stress MPa | Degree of deformation μm | Fatigue life |
|---|---|---|---|---|---|
| Example 1 | 1.2 | 1.4 | −196 | 15 | 2,049,369 |
| Example 2 | 2.9 | 2.8 | −204 | 17 | 1,987,585 |
| Comparative example 1 | 1.2 | 2.9 | −159 | 30 | 989,387 |
| Comparative example 2 | 2.9 | 3.5 | −187 | 38 | 1,122,127 |
| Comparative example 3 | 1.2 | 4.8 | −138 | 117 | 141,929 |
| Comparative example 4 | 2.9 | 5.3 | −169 | 109 | 12,319 |
| Example 3 | 1.64 | 1.69 | | 9.5 | 298,808 |
| Example 4 | 3.2 | 2.89 | | 7 | 337,802 |

From the results shown in Table 1 and FIG. 1 to FIG. 4 it is evident that compared with treatments by shot peening in Comparative Example 1 to Comparative Example 4 that used conventional shot materials, treatments by shot peening in Example 1 to Example 4 that used a microparticle shot material yielded a smaller variation in the surface roughness over the course of shot peening. It is thought that, as a result, shot peening in Example 1 to Example 4 results in less damage to the surface of the material. Furthermore, in shot peening in Example 1 and Example 2, a larger compressive residual stress was confirmed in the material following shot peening than that observed following shot peening in Comparative Example 1 to Comparative Example 4. Accordingly, shot peening in Example 1 to Example 4 enables alloy members having excellent fatigue properties to be obtained.

Furthermore, compared with the treatments by shot peening in Comparative Example 0.3 and Comparative Example 4, treatments by shot peening in Example 1 to Example 4 result in a smaller degree of deformation of the test specimen. Accordingly, shot peening in Example 1 to Example 4 removes the necessity for covering those regions for which increases in bending or surface roughness would prove problematic, meaning the steps of attaching and removing a mask are also unnecessary, and as a result, extra costs are not incurred in shot peening.

REFERENCE EXAMPLE

Figure 5:
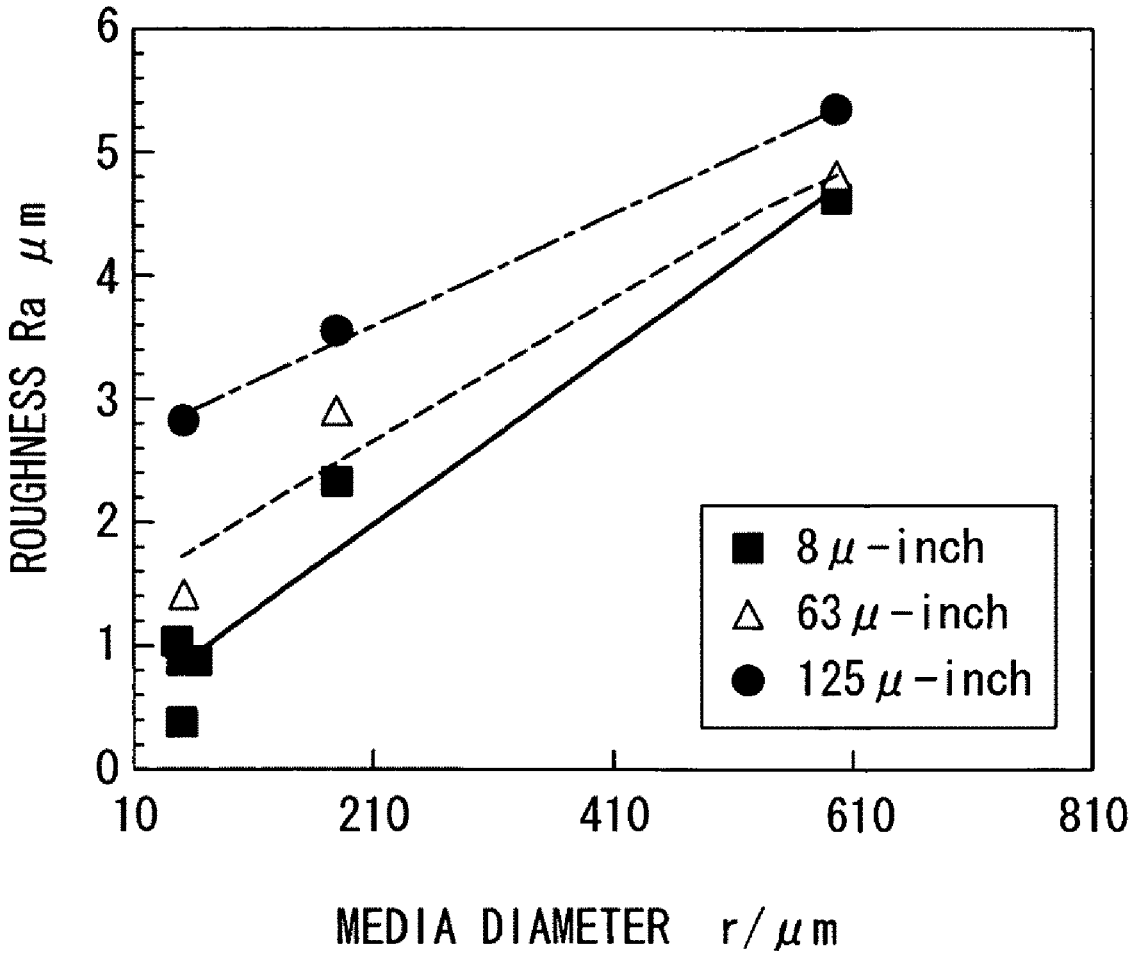
FIG. 5 A graph showing the relationship between the average particle size of the shot material and the surface roughness.

The relationships between the average particle size (the media diameter) (most frequent particle size) of the shot material and the surface roughness when the surfaces of aluminum alloy materials (7050-T7451) having nominal surface roughness values of 8 microinches (0.2 μm), 63 microinches (1.6 μm) and 125 microinches (3.2 μm) were shot peened are shown in FIG. 5. As shown in FIG. 5, it is clear that a linear relationship exists between the average particle size and the surface roughness, with the surface roughness increasing with increasing average particle size. Furthermore a trend is observed wherein smaller initial surface roughness values yield a greater variation in surface roughness upon changes in the average particle size, and when the average particle size approaches the average particle size (around 0.8 mm) of the shot materials used in typical treatments by shot peening, the effect of the initial surface roughness is almost non-existent, with the surface roughness following shot peening being substantially equal for all of the specified aluminum alloy materials.

EXAMPLE 5

Figure 6:
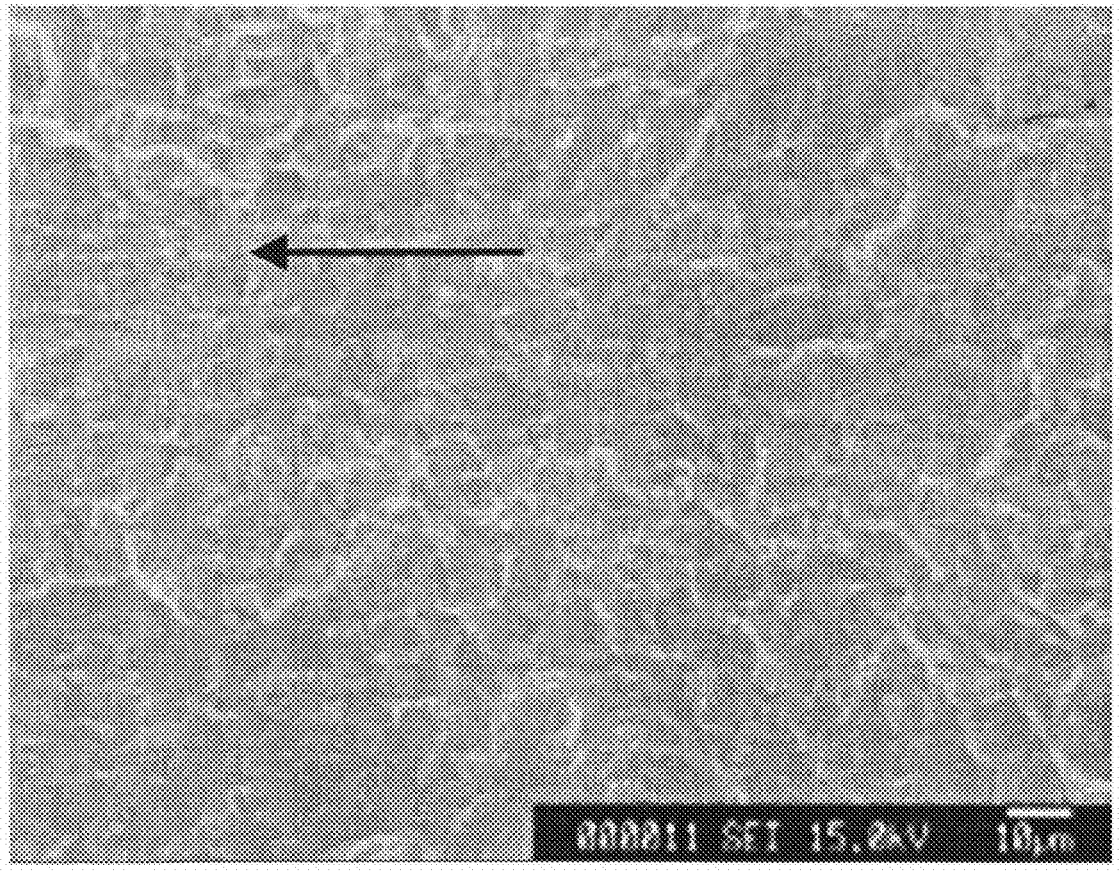
FIG. 6 An electron microscope photograph of the fatigue fracture surface of a specimen from Example 5.

The area around the hole within a test specimen composed of a flat sheet of a titanium alloy (Ti-6Al-4V (an annealed material)) with a hole formed therein was shot peened in the same manner as Example 3. No processing such as chamfering or rounding of the hole edges was performed prior to shot peening. Following a fatigue test, the fatigue fracture surface was inspected using an electron microscope. FIG. 6 is an electron microscope photograph of the fatigue fracture surface of the specimen from Example 5. In the figure, the arrow indicates the fatigue fracture origin.

From the electron microscope photograph of FIG. 6 it is evident that the fatigue fracture origin is several tens of μm inside the inner surface of the hole within the specimen of Example 5.

The results of performing a fatigue test (a tension-tension fatigue test, stress ratio R=0.1) using the above hole-containing flat sheet are shown in Table 2. It is clear that despite the fact that no processing such as chamfering or rounding of the hole edges was performed, using a microparticle shot enabled a dramatic improvement in the fatigue life beyond the result achievable using a typical shot material on a test specimen that had been subjected to processing such as chamfering or rounding of the hole edges (see Comparative Example 5 below).

TABLE 2

| Material/Test stress (MPa) | Reamed hole | Typical shot treatment | Micro-particle shot treatment | Fatigue life improvement (microparticle shot/reaming) |
|---|---|---|---|---|
| SNCM439 tempered steel/620 | 83,703 | 79,194 | 10,100,748 (no fracture) | 120-fold or more |
| Ti—6Al—4V annealed material/540 | 38,516 | 58,850 | 464,451 | 12-fold |
| A7075-T73/200 | 81,001 | 88,489 | 1,005,819 | 12-fold |

COMPARATIVE EXAMPLE 5

Figure 7:
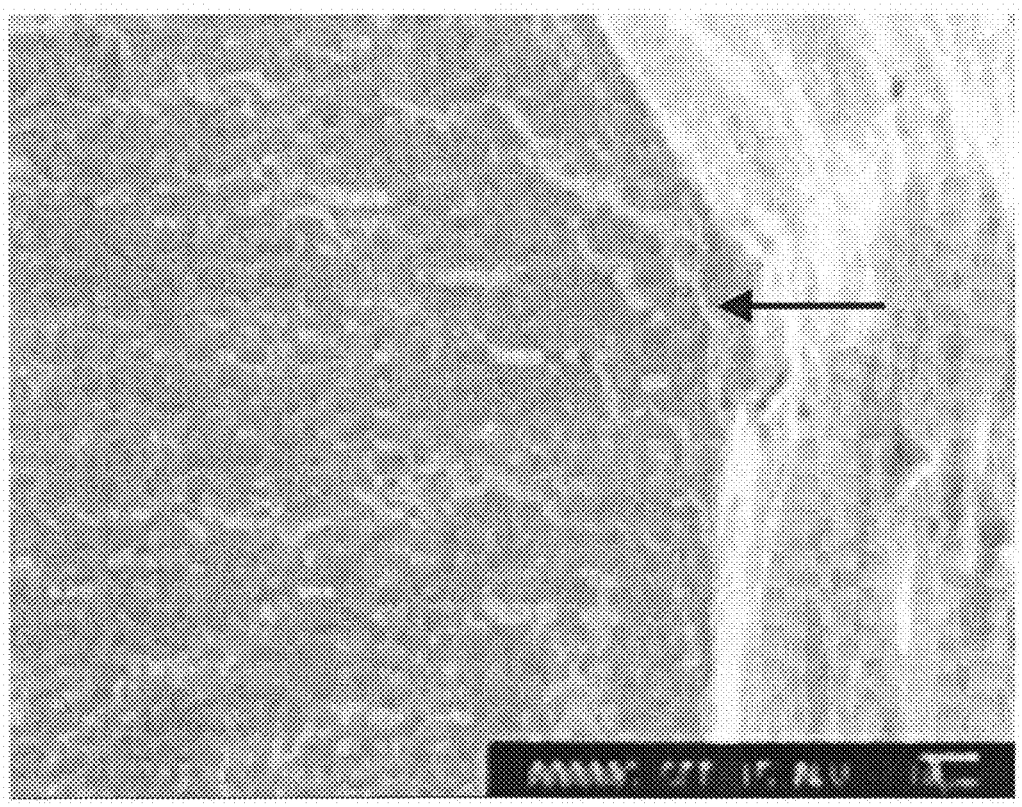
FIG. 7 An electron microscope photograph of the fatigue fracture surface of a specimen from Comparative Example 5.

The edges of the hole in a test specimen composed of a hole-containing sheet of a titanium alloy (Ti-6Al-4V (an annealed material)) were chamfered, and the area around the hole was then shot peened in the same manner as Comparative Example 3 and Comparative Example 4. Following a fatigue test, the fatigue fracture surface was inspected using an electron microscope. FIG. 7 is an electron microscope photograph of the fatigue fracture surface of the specimen from Comparative Example 5. In the figure, the arrow indicates the fatigue fracture origin.

From the electron microscope photograph of FIG. 7 it is evident that the fatigue fracture origin occurs at the chamfered portion of the hole edge in Comparative Example 5.

Comparison of Example 5 and Comparative Example 5 reveals that with microparticle shot peening, even though no corner chamfering had been performed, the edges did not act as fatigue fracture origins. Similar results were observed for aluminum alloy and steel test specimens. Based on these results, it can be stated that shot peening according to the present invention not only enables prevention of burrs caused by plastic deformation of edges, but also strengthens the entire surface including the edges, and improves the fatigue properties.

Furthermore, by taking advantage of the fact that shot peening according to the present invention produces a minimal degree of plastic deformation, shot peening can also be performed on precision hole portions, which until now have been unable to be shot peened and have therefore required covering.

The invention claimed is:

1. A process for producing a metallic component, comprising a projection step of projecting particles onto a surface of a metallic material comprising a lightweight alloy or a steel, wherein an average particle size of the particles is not more than 200 μm, and a ratio of an arithmetic mean roughness of the surface of the metallic material following the projection step relative to the arithmetic mean roughness of the surface of the metallic material prior to the projection step is not less than 0.8 and not more than 1.5.

2. The process for producing a metallic component according to claim 1, wherein an arithmetic surface roughness of the surface of the metallic material prior to the projection step is not less than 0.7 μm and not more than 65 μm.

3. The process for producing a metallic component according to claim 1, wherein an absolute value of a compressive residual stress at the surface of the metallic material following the projection step is not less than 150 MPa.

4. The process for producing a metallic component according to claim 1, wherein projection of the particles onto the surface of the metallic material is performed without using a mask to cover the surface of the metallic material.

5. The process for producing a metallic component according to claim 1, wherein neither chamfering nor rounding of edges of the metallic material is performed prior to the projection step.

6. A structural member having a metallic component produced using the process according to claim 1.

* * * * *